United States Patent [19]

Biemans

[11] Patent Number: 4,557,408

[45] Date of Patent: Dec. 10, 1985

[54] NEEDLE THREADING DEVICES

[76] Inventor: Arnoldus Biemans, Mathenesserlaan 432, 3023 Hg Rotterdam, Netherlands

[21] Appl. No.: 634,224

[22] Filed: Jul. 25, 1984

[51] Int. Cl.[4] ..... D05B 87/02

[52] U.S. Cl. ..... 223/99; 112/225

[58] Field of Search ..... 112/225; 223/99; D3/18

[56] References Cited

U.S. PATENT DOCUMENTS

| | | | |
|---|---|---|---|
| D. 161,280 | 12/1950 | Pinkham et al. | 223/99 X |
| D. 242,749 | 12/1976 | Matthews | D3/18 |
| 524,896 | 8/1894 | Goldman . | |
| 2,169,124 | 8/1939 | Holland | 112/225 |
| 2,281,180 | 4/1942 | Christ | 223/99 |
| 2,311,665 | 2/1943 | Kahn | 223/99 |
| 2,338,159 | 1/1944 | Appleton | 223/99 |
| 2,476,872 | 7/1949 | Jamo | 112/225 |
| 2,507,370 | 5/1950 | Edwards | 223/99 |
| 2,525,034 | 10/1950 | Jamo | 112/225 |
| 2,641,394 | 6/1953 | Cotter | 223/99 |
| 2,679,959 | 6/1954 | Von Ullisperger et al. | 223/99 |
| 2,700,840 | 2/1955 | Butts | 223/99 |
| 2,701,669 | 2/1955 | David | 223/99 |
| 3,000,545 | 9/1961 | Ullisperger | 223/99 |
| 3,289,902 | 12/1966 | Fritts | 223/99 |
| 4,198,915 | 4/1980 | Peterson et al. | 112/225 |
| 4,461,409 | 7/1984 | Biemans | 223/99 |

FOREIGN PATENT DOCUMENTS

| | | | |
|---|---|---|---|
| 494383 | 7/1950 | Belgium | 223/99 |
| 463639 | 9/1948 | Canada | 223/99 |
| 2946 | 4/1900 | Denmark | 223/99 |
| 2836858 | 3/1980 | Fed. Rep. of Germany . | |
| 1048724 | 12/1953 | France | 223/99 |
| 1066463 | 6/1954 | France | 223/99 |
| 1108740 | 1/1956 | France . | |
| 488887 | 1/1954 | Italy . | |
| 1465696 | 2/1977 | United Kingdom . | |

*Primary Examiner*—Werner H. Schroeder
*Assistant Examiner*—Andrew M. Falik
*Attorney, Agent, or Firm*—Body, Vickers & Daniels

[57] ABSTRACT

A manually operable needle threading device comprises a housing having a recess for positioning the eye of a needle to be threaded in alignment with the path of a displaceable thread pusher member in the housing, whereby displacement of the pusher member from a retracted to an extended position pushes a portion of a thread between the needle and pusher member through the needle eye. The pusher member displaces the portion of thread between gripping fingers on the housing which hold the thread portion upon displacement of the pusher member from the extended to the retracted position. The portion of thread remains attached to the threading device upon separation of the needle therefrom until a loose end of the thread passes through the needle eye to complete the threading operation, after which the thread portion is released from the threading device. In one embodiment the housing is of pistol-like configuration facilitating handling and operation of the threading device.

28 Claims, 14 Drawing Figures

NEEDLE THREADING DEVICES

BACKGROUND OF THE INVENTION

This invention relates to improvements in needle threading devices of the type having a needle threading member manually operable to displace a thread through the eye of a needle supported relative to the device.

Manually operable needle threading devices of the type to which the present invention relates are generally known and, in this respect, include a needle threading member supported in a housing for displacement through the eye of a needle supported by the housing in alignment with the member. The needle threading member operates to push the thread through the needle eye, and threading of the needle is completed by grasping the portion of the thread pushed through the needle eye prior to or during separation of the needle from the device. If the portion of thread is not so grasped, removal of the needle from the device can result in unthreading of the needle, whereby the needle threading procedure must be repeated. Moreover, grasping of the portion of thread pushed through the needle eye is difficult in that the thread portion is extremely small. The latter problem is especially troublesome in connection with threading of sewing machine needles in that the space between the backside of the needle and the foot pad of the sewing machine is rather small. Such limited space, together with visual impairment caused by the presence of the threading device between the user and the area in which the user's hand must work, makes it extremely difficult to grasp the thread.

An additional disadvantage in connection with such manually operable threading devices heretofore provided resides in the fact that the threading procedure therewith is tedious and requires the simultaneous use of both hands throughout the threading operation. More particularly, in a sewing machine needle threading operation one hand is required to position, support and/or operate the device to displace the needle threading member and, following such displacement, the second hand is required to grasp the free end of the thread to prevent unthreading of the needle upon separation of the device from the needle. The latter separation requires continued use of the one hand to support the threading device. The requirement for both hands to be in the vicinity of the sewing machine needle at the same time also makes the threading operation somewhat cumbersome. Moreover, the threading of a hand sewing needle is likewise tedious and cumbersome in that the needle must be supported by the housing so that one hand of the user can support the housing during manipulation of the device by the other hand. Thereafter, one of the user's hands must still support the housing while the other grasps and pulls the free end of the thread through the needle and then the needle must be grasped for separation from the threading device.

SUMMARY OF THE INVENTION

Improved needle threading devices are provided in accordance with the present invention which advantageously enable the threading of a sewing machine needle or a hand sewing needle without the foregoing and other problems encountered in connection with manually operable needle threading devices heretofore provided. More particularly in this respect, a manually operable needle threading device according to one aspect of the present invention provides for a portion of a thread to be displaced through a needle eye and to then be engaged by and held against displacement relative to the device. Thereafter, separation of the needle from the device results in the free end of the thread being pulled through the eye, after which the held portion of the thread can be released from the threading device to complete the threading operation. Particularly in connection with the threading of a sewing machine needle, displacement of the needle from engagement with the threading device enables the device to be moved laterally away from the needle in order to achieve release of the portion of thread held by the device without visual obstruction and without the inconvenience of working in the small space behind the sewing machine needle and with both hands performing functions simultaneously. In connection with the threading of a hand sewing needle, a device according to the present invention advantageously enables the needle to be supported in one hand, the device manipulated by the other, and then separating of the needle from the device to complete pulling of the thread through the needle eye. Each hand of the user performs its function without having to shift back and forth relative to the needle, thread and/or housing at various times during the threading operation.

In accordance with another aspect of the present invention, a manually operable needle threading device is provided in which the housing is constructed somewhat in the form of a pistol or handle to facilitate holding the device between the fingers and palm with a portion of the device between the forefinger and thumb of a user. An actuator for achieving displacement of the threading member during a needle threading operation is disposed outside the housing in the area thereof between the thumb and forefinger for manipulation by the corresponding one of the latter. Such a housing construction advantageously enables support and manipulation of the device with ease and with stability and control with respect to positioning the device relative to the needle to be threaded. Furthermore, such a housing construction is especially useful in connection with threading a sewing machine needle in a sewing machine in which the clearance space between the needle and machine base is limited.

It is accordingly an outstanding object of the present invention to provide improved manually operable needle threading devices.

A further object is the provision of improved needle threading devices of the foregoing character which enable the threading of a needle, separation of the threaded needle from the device and pulling of the thread through the needle eye by the device.

Another object is the provision of improved needle threading devices which are easy to use with respect to threading both hand sewing and sewing machine needles.

A further object is the provision of an improved needle threading device in which the housing is in the form of a handle adapted to be gripped between the fingers and palm of a user, thus to enhance support and manipulation of the device during a needle threading operation.

Yet a further object is the provision of improved needle threading devices which are operable to engage and hold a portion of a thread displaced through the needle eye, whereupon separation of the device from the needle pulls a free end of the thread through the needle eye to complete the threading operation.

Still another object is the provision of needle threading devices which are structurally simple and economical to manufacture and which have improved versatility and efficiency in connection with achieving the threading of needles.

BRIEF DESCRIPTION OF THE DRAWINGS

The foregoing objects, and others, will in part be obvious and in part pointed out more fully hereinafter in conjunction with the written description of a preferred embodiment of the invention illustrated in the accompanying drawings in which.

DESCRIPTION OF PREFERRED EMBODIMENTS

Figure 1:
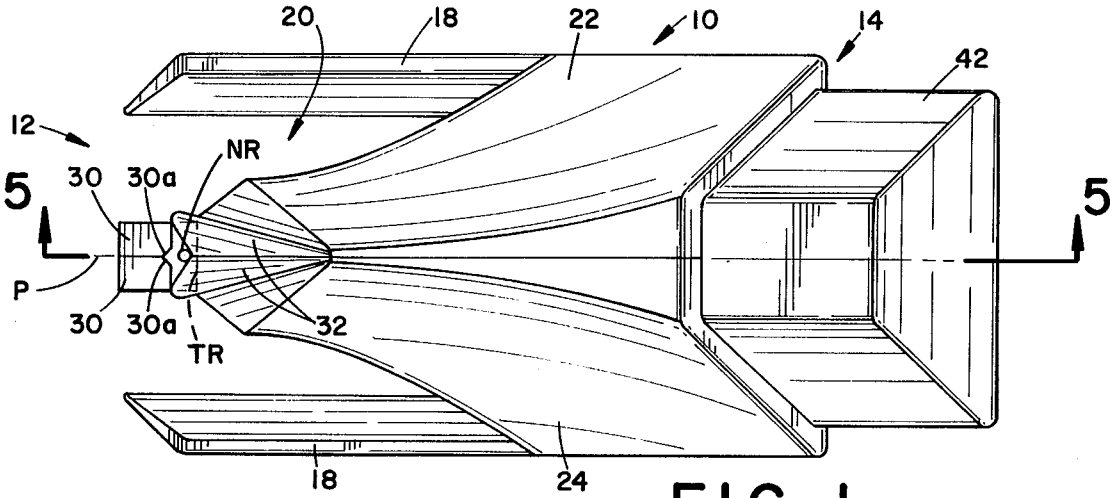
FIG. 1 is a plan view of a needle threading device made in accordance with the present invention.
Figure 2:
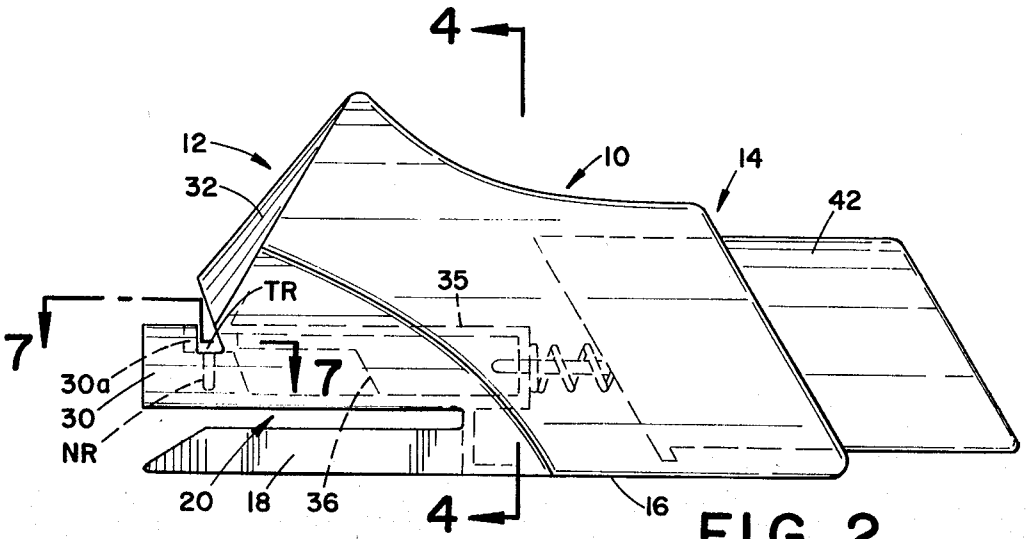
FIG. 2 is a side elevation view of the needle threading device.
Figure 3:
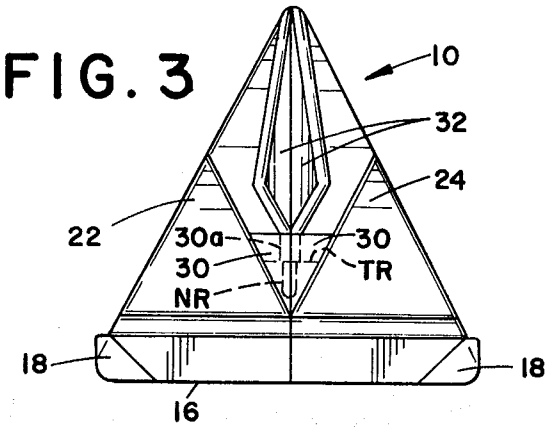
FIG. 3 is an end elevation view of the device looking in the direction from left to right in FIG. 1.

Referring now in greater detail to the drawings wherein the showings are for the purpose of illustrating preferred embodiments of the invention only, and not for the purpose of limiting the invention, FIGS. 1–3 illustrate a needle threading device comprising a housing 10 having longitudinally opposite ends 12 and 14. The housing includes a bottom side 16 by which the device is adapted to be supported on an underlying surface and which bottom side is defined in part by laterally spaced apart legs 18 extending towards end 12 of the housing from the inner end of a recess 20 by which end 12 is elevated from bottom side 16 for the purpose of enabling positioning of the device relative to a sewing machine needle. More particularly in this respect, legs 18 and recess 20 facilitate reception of the foot pad of a sewing machine in the recess and between the legs to position the machine needle for threading.

Figure 4:
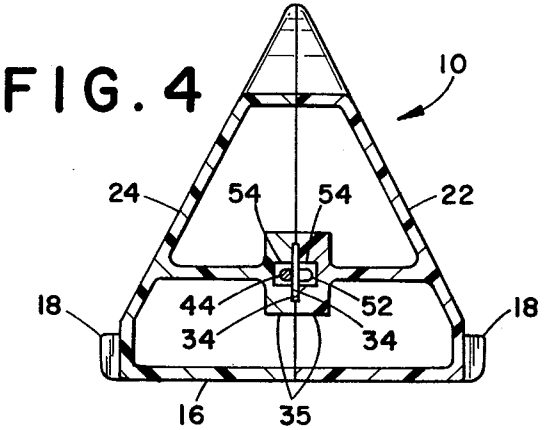
FIG. 4 is a cross-sectional elevation view of the device as seen along line 4—4 in FIG. 2.

In the embodiment illustrated, housing 10 is comprised of laterally interconnected housing halves 22 and 24 of suitable plastic material. As will be appreciated in particular from FIGS. 4–6 and the illustrations in FIGS. 1–3, the laterally inner sides of housing halves 22 and 24 are cooperatively contoured for the halves when assembled to support operating component parts of the device and to define needle and thread positioning recesses and a thread gripping portion at end 12 of the housing. More particularly in this respect, and as will be appreciated from the illustration of housing half 22 in FIG. 5, each housing half is provided with a vertical, semi-circular recess 26, a laterally open recess 28 adjacent recess 26 in the direction from end 12 towards end 14 of the housing, and a gripping finger 30 above and adjacent recess 26 in the direction from end 14 towards end 12 of the housing. When the housing halves are assembled, recesses 26 cooperatively provide a vertical needle positioning recess designated NR in FIGS. 1–3, and recesses 28 cooperatively define a laterally open thread positioning recess designated TR in FIGS. 1–3. Further, when the housing halves are assembled the planar inner sides of gripping fingers 30 facially engage one another for the purpose set forth hereinafter. Preferably, in connection with the latter purpose and for the reason which will become apparent hereinafter, fingers 30 are each beveled as at **30*a* to provide a converging entrance to the interface therebetween in the direction from end 14 towards end 12** of the housing.

Preferably, each of the housing halves is provided with a needle guide wing 32 and which guide wings cooperatively interengage to provide a needle guide channel having a bottom edge in longitudinal alignment with needle positioning recess NR and along which a needle can be moved to facilitate introduction of the needle into the recess. As will be further appreciated from FIGS. 4–6, the laterally inner sides of the housing halves are each provided with a longitudinally extending guide recess 34 in a corresponding rib 35 integral with the housing half. When the housing halves are assembled, recesses 34 cooperate to receive and support a thread pusher member 36 for longitudinal reciprocation relative to the housing along a path P. Thread pusher member 36 has outer and inner ends 38 and 40, respectively, and is reciprocable between a retracted position shown in FIG. 5 and an extended position shown in FIG. 6 and in which outer end 38 is respectively inwardly adjacent thread supporting recess TR and outwardly beyond the outer extremity of gripping fingers 30.

Displacement of thread pusher member 36 between the retracted and extended positions is achieved by means of an actuator assembly including a push button 42, an actuating rod 44 and a biasing spring 46. The laterally inner sides of housing halves 22 and 24 at end 14 of the housing are cooperatively contoured to receive and reciprocably support push button 42 and, as will be appreciated from the illustration of housing half 22 in FIG. 5, each of the housing halves is provided with a push button supporting wall 48 spaced inwardly from the outer end of the housing portion. The outer end wall of push button 42 is provided with a recessed projection 50 frictionally or otherwise securely receiving the corresponding end of rod 44, and inner end 40 of thread pusher member 36 is apertured to receive the inner end 52 of rod 44 which is accordingly bent to extend laterally through the opening in end 40 of the pusher member. Ribs 35 in housing halves 22 and 24 are provided with longitudinally extending recesses 54 opening laterally into the corresponding recess 34 and which recesses 54 accommodate rod 44 and end 52 thereof during reciprocation of the pusher member between the retracted and extended positions thereof.

Rod 44 is provided with a collar 56 which is suitably secured thereto intermediate the opposite ends thereof, and spring 46 surrounds rod 44 between collar 56 and inner ends 58 of ribs 35 of the housing halves. Spring 46 biases rod 44 and thus push button 42 to the right in FIG. 5, and thus operates to bias thread pusher member 36 to the retracted position thereof. As will be appreciated from FIG. 6, displacement of push button 42 to the left in FIG. 5 operates to displace thread pusher member 36 to the extended position thereof against the bias of spring 46. Upon release of push button 42, spring 46 operates to displace the push button and thread pusher member 36 back to the position shown in FIG. 5. Preferably, the lower inner end of push button 42 is provided with a downwardly extending flange 60 which engages against wall 48 to limit displacement of pusher member 36 and push button 42 in the direction of retraction of the pusher member. Housing halves 22 and 24 can be laterally interconnected in any suitable manner to maintain the component parts in assembled relationship. Such interconnection, for example, may be by the provision of interengaging projections and recesses between the housing halves and/or by adhesive bonding. However, for the reason which will become apparent in connection with the description of the operation of the device, it will be noted that gripping fingers 30 are not laterally interconnected in any manner which would prevent lateral displacement therebetween to achieve movement of the thread pusher member therebetween upon displacement of the thread pusher member to the extended position thereof.

Figure 7:
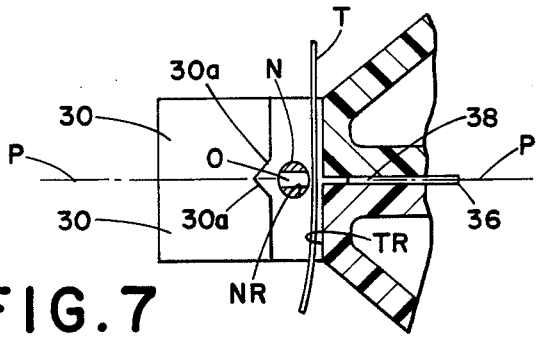
FIG. 7 is an enlarged plan view, partially in section, taken along line 7—7 in FIG. 2 and showing the positional relationships between a needle eye, thread and thread pusher member in preparation for threading the needle.
Figure 9:
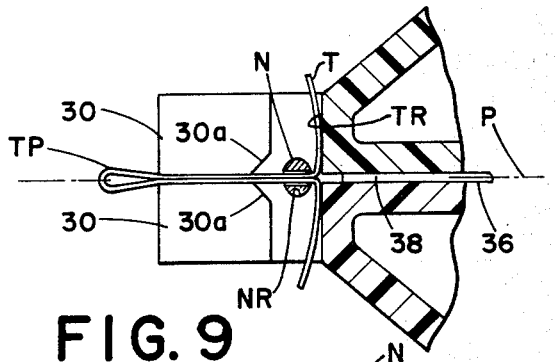
FIGS. 8 and 9 are plan views similar to FIG. 7 and showing the relative positions of the component parts during the threading operation.
Figure 8:
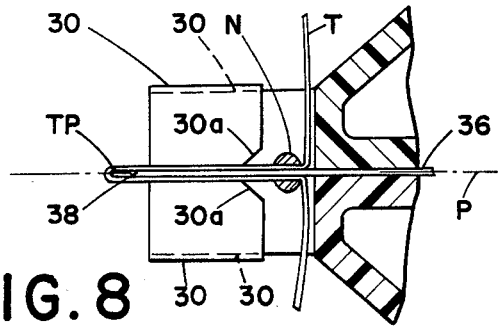
Figure 10:
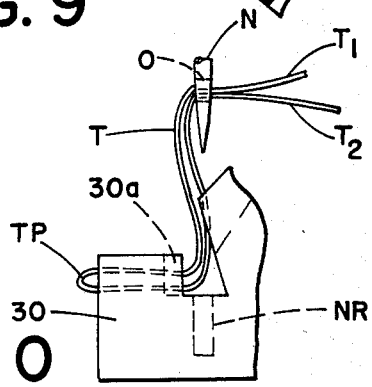
FIG. 10 is a detail side elevation view illustrating completion of the threading operation.

FIGS. 7–10 illustrate the sequence of operation in connection with the threading of a needle with the threading device described hereinabove. In this respect, with reference to FIG. 7, a needle N to be threaded is introduced into needle positioning recess NR which operates to vertically and laterally align needle eye 0 with path P of thread pusher member 36. A strand of thread T is then laid laterally across the device in thread positioning recess TR which vertically positions the thread with respect to path P. While only a short length of thread T is illustrated, it will be appreciated that one end of the thread can be attached such as to a spool or material being sewed and the length of the free end of the thread laid across the device will be sufficient for pushing of the thread through the needle eye. With the needle and thread positioned as shown in FIG. 7, push button 42 is displaced inwardly of housing 10 whereby thread pusher member 36 is displaced from the retracted to the extended position. As will be appreciated FIG. 8, such displacement of thread pusher member 36 causes end 38 thereof to engage thread T and displace a portion TP of the thread through the needle eye and between gripping fingers 30. Beveled edges **30*a* of the fingers facilitate lateral outward displacement of the fingers for movement of end 38 of the pusher member and thread portion TP between the fingers, and such displacement biases fingers 30 laterally outwardly from the broken line to the solid line positions shown in FIG. 8 and against the inherent bias tending to return the fingers to their laterally innermost positions. Push button 42 is then released for spring 46 to displace thread pusher member 36 from the extended back to the retracted position. During such retracting displacement of pusher member 36, the latter slides from between thread portion TP whereby, as seen in FIG. 9, thread portion TP is laterally clampingly engaged between gripping fingers 30 when pusher member 36 is returned to the retracted position. Then, as will be appreciated from FIG. 10, separation of needle N from positioning recess NR results in pulling of the strands of thread T through needle eye 0 while portion TP remains gripped between fingers 30. Thread T is shown in FIG. 10 as having ends T1 and T2. End T1 represents the free end of the thread close to the needle, and end T2 represents the opposite end spaced a considerable distance from the needle and/or fixedly secured to a spool or the like. Accordingly, it will be appreciated that as needle N is further separated from the threading device from the position shown in FIG. 10, free end T1 will eventually be pulled through needle eye 0 to the left hand side thereof in FIG. 10. Thereafter, thread portion TP can be pulled from between gripping fingers 30** whereupon the needle threading operation is completed.

FIGS. 11–14 of the drawing illustrate further improvements relating to manually operable needle threading devices and in part in this respect disclose another embodiment of a needle threading device in which threading of a needle is achieved in the manner described hereinabove in connection with the embodiment of FIGS. 1–10. In the embodiment illustrated in FIGS. 11–14, the needle threading device includes a housing 70 having longitudinally opposite ends 72 and 74 and comprised of laterally interconnected housing halves 76 and 78 of suitable plastic material. As will be appreciated from FIGS. 12–14, the laterally inner sides of housing halves 76 and 78 are cooperatively contoured for the halves, when assembled, to support operating parts of the device and to define needle and thread positioning recesses and a thread gripping portion at end 72 of the housing. More particularly in this respect, as will be appreciated from the illustration of housing half 76 in FIG. 12, each housing half is provided with a vertical, semi-circular recess 80, a laterally open recess 82 adjacent recess 80, and a gripping finger 84 on the opposite side of recess 80. When the housing halves are assembled, recesses 80 cooperatively define a vertical needle positioning recess and recesses 82 cooperatively define a laterally open thread positioning recess, respectively designated NR′ and TR′ in FIG. 11. Further, as in the embodiment of FIGS. 1–10, when the housing halves are assembled the planar inner sides of gripping fingers 84 facially engage one another to grip a thread therebetween during a needle threading operation. Each of the housing halves is further provided with a needle guide wing 86 to facilitate positioning a needle in longitudinal alignment with needle positioning recess NR′ to facilitate introduction of the needle into the recess.

Figure 5:
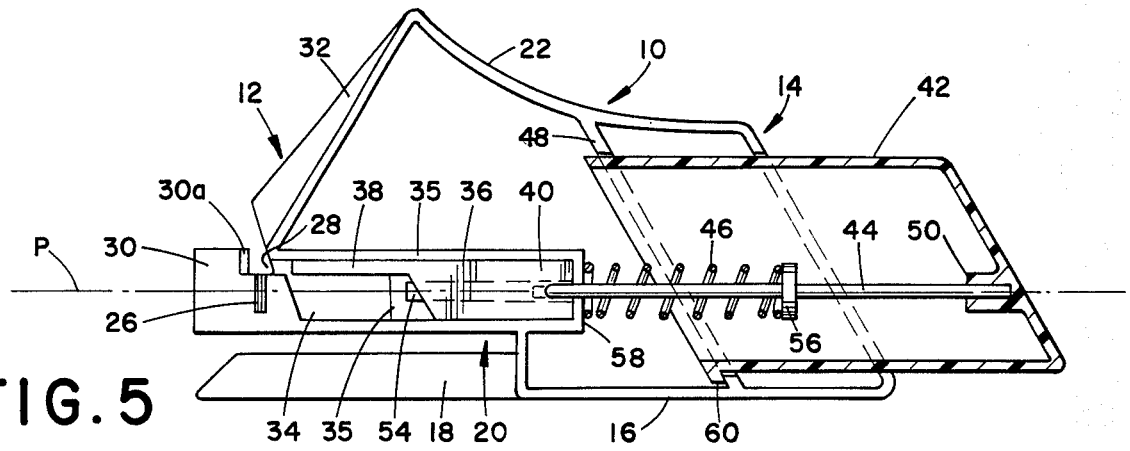
FIG. 5 is a sectional elevation view of the device taken along line 5—5 in FIG. 1 and showing the thread pusher member in its retracted position.
Figure 6:
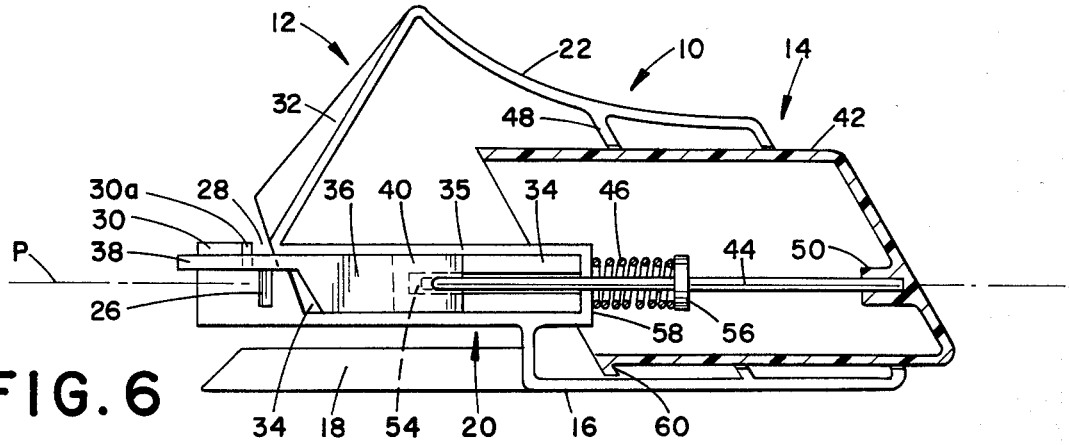
FIG. 6 is a sectional elevation view similar to FIG. 5 and showing the thread pusher member in its extended position.
Figure 12:
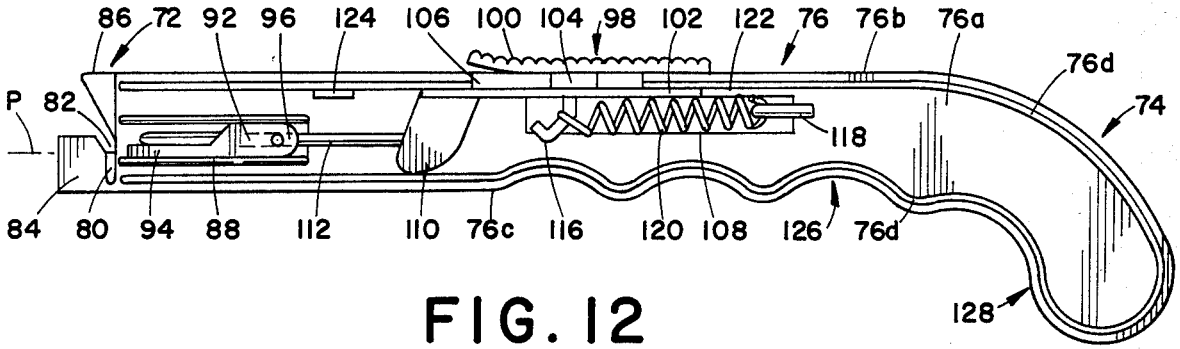
FIG. 12 is a sectional elevation view of the device taken along line 12—12 in FIG. 11.
Figure 13:
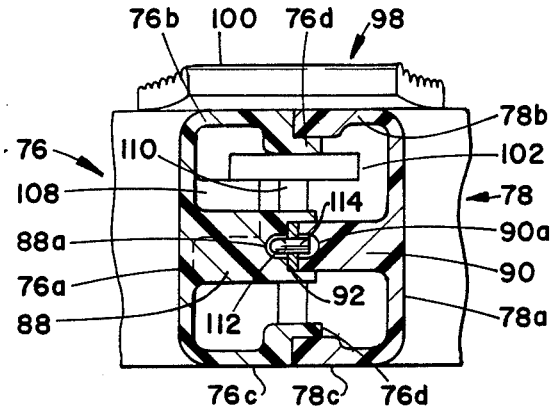
FIG. 13 is a cross-sectional elevation view taken along line 13—13 in FIG. 11; and, FIG. 14 is a cross-sectional elevation view taken along line 14—14 in FIG. 11.
Figure 14:
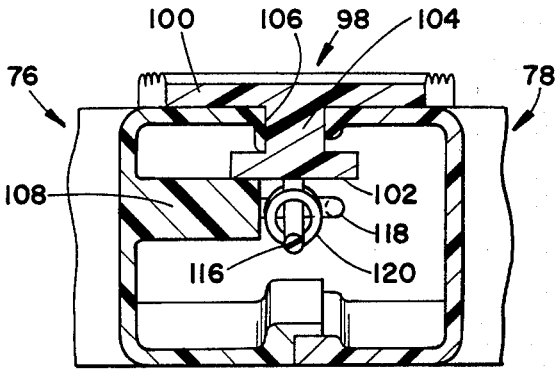

As will be appreciated from FIGS. 12 and 13, the laterally inner sides of housing halves 76 and 78 are provided with longitudinally extending ribs 88 and 90, respectively. When the housing halves are assembled, the ribs cooperatively provide a longitudinally extending guide recess which receives and supports a thread pusher member 92 for longitudinal reciprocation relative to the housing along a path P. Further, thread pusher member 92 has outer and inner ends 94 and 96, respectively, and is reciprocable between retracted and extended positions as shown in FIGS. 5 and 6 with respect to thread pusher member 36 of the first embodiment.

Displacement of thread pusher member 92 between the retracted and extended positions is achieved by means of an actuator assembly including an actuator component 98 supported by the housing for longitudinal sliding movement relative thereto. More particularly, actuator component 98 includes a slide member 100 outwardly adjacent the top of the housing and a slide support member 102 inside the housing and interconnected with slide member 100 by means of a post 104 which extends through a longitudinal guide slot defined by guide recesses 106 in the housing halves. The laterally inner side of housing half 76 is provided with a longitudinally extending rail member 108 receiving the corresponding side of slide support member 102 to provide support and guidance for the actuator assembly. The forward end of support member 102 includes a depending wing 110 which slidably engages the bottom of the housing and which supports an actuating rod 112 having an end 114 bent to extend through an opening therefore in inner end 96 of thread pusher member 92. Ribs 88 and 90 are provided with corresponding longitudinally extending recesses 88*a* and 90*a* to accommodate rod 112 and end 114 thereof during reciprocation of the thread pusher member. The underside of slide support member 102 is provided with a downwardly extending post 116, and the rear end of member 108 is provided with a laterally inwardly extending post 118, and a biasing spring 120 has its opposite ends interengaged with posts 116 and 118 to bias actuator assembly 98 and thus thread pusher member 92 to the retracted position shown in FIG. 12. A stop member 122 on housing half 76 is engaged by the rear end of slide support member 102 to limit displacement of the actuator assembly and thread pusher member in the direction of retraction, and a similar stop member 124 is positioned on housing half 76 forwardly of slide support member 102 for engagement thereby to limit displacement of the actuator assembly and thread pusher member in the direction of extension. It will be appreciated from FIG. 12 that displacement of slide member 100 to the left and forwardly of the housing operates to displace thread pusher member 92 to the extended position thereof against the bias of spring 120 and that, upon release of slide member 100, spring 120 operates to displace the slide member and thread pusher member 92 back to the retracted position shown in FIG. 12.

Operation of the embodiment illustrated in FIGS. 11–14 in connection with the threading of a needle is the same as that for the embodiment of FIGS. 1–6. Accordingly, operation of the present embodiment will be understood from the description of the operation hereinabove with reference to FIGS. 7–10.

The structural configuration of housing 70 is of primary importance in connection with another aspect of the present invention. In this respect, housing half 76 includes a side wall 76*a*, a top wall portion 76*b* and a bottom wall portion 76*c*, and housing half 78 includes a side wall 78*a*, a top wall portion 78*b* and a bottom wall portion 78*c*. When the housing halves are assembled, the latter walls and wall portions of the two halves provide for housing 70 to have vertically spaced apart top and bottom walls and laterally spaced apart side walls between ends 72 and 74 of the housing. Housing halves 76 and 78 can be laterally interconnected in any suitable manner and, in the embodiment herein illustrated, such interconnection is achieved by providing the laterally inner edges of the top and bottom wall portions of housing half 76 with a laterally inwardly extending flange 76*d* which overlies the inner side of the corresponding wall portion of housing half 78. A suitable adhesive can be interposed between the overlapped portions to secure the housing halves together against unintentional lateral separation. As will be appreciated from the drawings housing 70 has a length between ends 72 and 74 several times greater than each of the width and height dimensions of the housing as defined by the spacing between the side walls and the spacing between the top and bottom walls, respectively. Preferably, the bottom wall of the housing is provided with a series of undulations intermediate the ends 72 and 74 as indicated generally by the numeral 126 in FIGS. 11 and 12.

Figure 11:
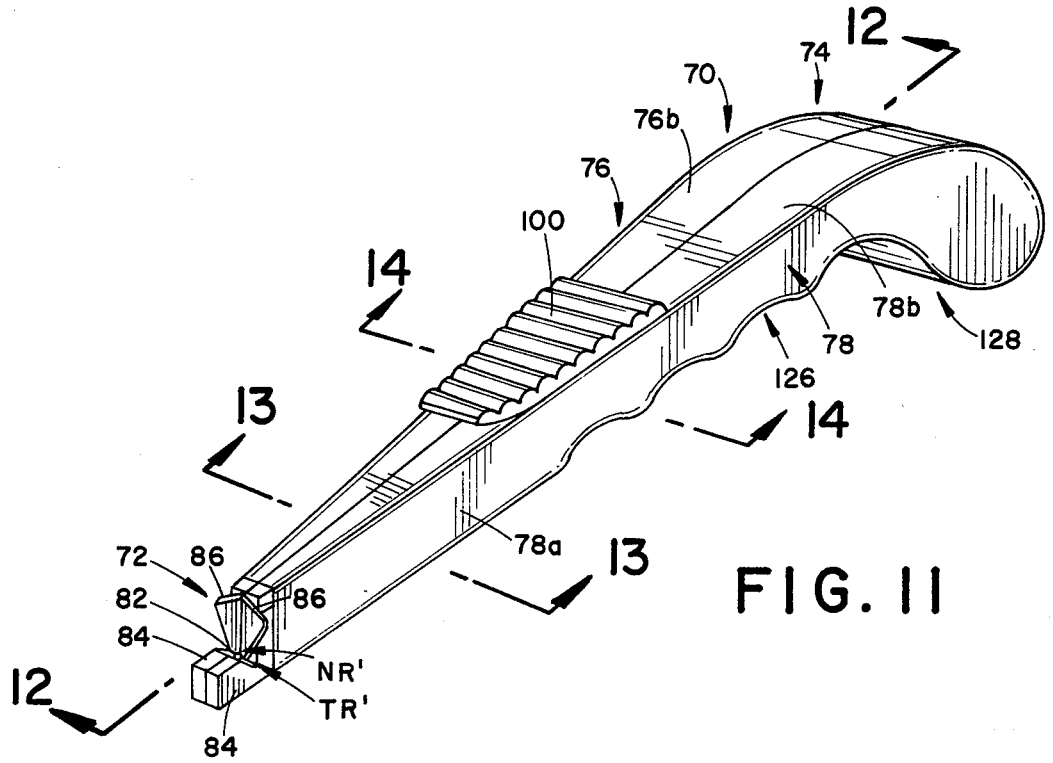
FIG. 11 is a perspective view of another embodiment of needle threading devices according to the present invention.

Preferably, the side walls of the housing diverge relative to one another in the direction from front end 72 towards rear end 74 as shown in FIG. 11. This diverging relationship advantageously enables providing a minimum width dimension at end 72 while providing a width at end 74 which enables the housing to be held in the hand of a user in the manner described below. The narrow dimension at front end 72 is desirable from the standpoint of economy and appearance and also from the standpoint of optimizing visibility with respect to positioning the device relative to a needle to be threaded.

The dimensions of the housing are such as to facilitate holding of the needle threading device in a person's hand with slide member 100 and the underlying undulation in the bottom wall respectively between the thumb and forefinger, whereby it will be appreciated that the undulations behind the one accommodating the forefinger respectively accommodate the second, ring and little finger of the user. The width of the housing in this area is such as to facilitate grasping the opposite side walls of the housing between the tips of the second, ring and little fingers and the palm of the hand, and the endmost portions of the housing walls at end 74 are curved to extend downwardly to provide a somewhat bulbous portion 128 extending downwardly behind the little finger when the housing is held in the foregoing manner. As will be appreciated from FIGS. 12 and 13, the bottom wall of housing 70 is planar between end 72 and the first undulation, and bulbous portion 128 extends below the plane of the bottom wall. This housing configuration advantageously provides for the needle threading device to be comfortably accommodated in a user's hand while being supported with stability for use and in a manner which enables the front end to be quickly aligned with a needle to be threaded and for threading then to be achieved simply by pushing slide member 100 forwardly with the thumb. The housing configuration also enables minimizing the vertical dimension of the device at front end 72, and this small vertical dimension is especially advantageous in connection with threading the needle of a sewing machine wherein space limitations either preclude or make it difficult to use a threading device of the structure illustrated in FIGS. 1–6 of the drawing.

By way of example, and with reference to the illustrated embodiment, the foregoing capabilities and advantages can be achieved with a housing which is about $6\frac{1}{4}''$ long and in which the distance between the front end of slide member 100 and the extremity of end 74 of the housing is about 4". The width of the housing tapers generally uniformly from about 3/16" at front end 72 to about 1-3/16" at end 74, and the vertical height between the planes of the top and bottom walls from end 72 to the undulation in the bottom wall immediately preceding the depending bulbous portion 128 is about 9/16".

The undulations have a depth of about ⅛" toward the top wall. While a housing of such configuration and dimension provides the desired attributes for the needle threading device, it will be appreciated that the foregoing dimensions and configuration can be varied without eliminating the desired end results regarding one hand support of the device and manipulation of the actuator to achieve threading of a needle therewith.

While considerable emphasis has been placed herein on the specific structure and structural interrelationship between the component parts of the illustrated embodiments, it will be appreciated that many changes can be made therein without departing from the principles of the present invention. Particularly in this respect, it will be appreciated that thread gripping arrangements other than gripping fingers integral with the housing halves can be devised for achieving the desired function of engaging and holding a thread portion upon return of the thread pusher member to the retracted position. In this respect, for example, gripping components separate from and mounted on the housing halves, or mounted on the housing following assembly thereof, can be devised to serve the desired purpose. Further, other arrangements for supporting the reciprocable pusher members can be devised as can be other arrangements for biasing the pusher members to the retracted positions thereof. Particularly in connection with the embodiment illustrated in FIGS. 11–14, it will be appreciated that the advantages of supporting and manipulating a manually operable needle threading device can be achieved with the disclosed housing configuration independent of the use of gripping fingers. These and other changes will be obvious and suggested to those skilled in the art upon reading the foregoing description, whereby it is to be distinctly understood that the foregoing descriptive matter is to be interpreted merely as illustrative of the present invention and not as a limitation.

Having thus described the invention, it is claimed:

1. A needle threading device comprising, housing means, needle threading member means supported in said housing means for displacement in opposite directions along a path relative to said housing means, means to displace said member means in opposite directions, needle positioning means on said housing means removably receiving a needle to be threaded, thread positioning means on said housing means, said needle positioning means and said thread positioning means being operable respectively to position the eye of a needle and a thread in alignment with said path for said member means to displace a portion of said thread through said eye from one side of said needle to the other when said member means is displaced in one of said opposite directions, and means on said housing means adjacent said other side of said needle for engaging and holding said portion of said thread against displacement relative to said housing means when said needle is removed from said needle positioning means.

2. A needle threading device according to claim 1, wherein said needle positioning means and thread positioning means include a vertical needle positioning recess in said housing means and a laterally open thread positioning recess adjacent said one side of said needle.

3. A needle threading device according to claim 1, wherein said means to displace said member means includes manually displaceable actuator means for displacing said member means in said one direction, and biasing means biasing said member means in said other of said opposite directions.

4. A needle threading device according to claim 3, wherein said housing means has opposite ends, said needle a positioning means and thread positioning means being at one of said opposite ends, and said actuator means being at the other of said opposite ends.

5. A needle threading device according to claim 4, wherein said path is linear between said opposite ends, and said actuator means includes a push button supported by said housing means for reciprocation along said path.

6. A needle threading device according to claim 5, wherein said push button has depressed and released positions relative to said housing means, and said biasing means includes a spring biasing said push button toward said released position thereof.

7. A needle threading device according to claim 1, wherein said means on said housing means for engaging and holding said portion of said thread includes thread gripping means on said housing means.

8. A needle threading device according to claim 7, wherein said gripping means includes gripping fingers on laterally opposite sides of said path.

9. A needle threading device according to claim 7, wherein said needle position means and thread positioning means include a vertical needle positioning recess in said housing means and a laterally open thread positioning recess adjacent said one side of said needle.

10. A needle threading device according to claim 9, wherein said gripping means includes gripping fingers on laterally opposite sides of said path.

11. A needle threading device according to claim 10, wherein said means to displace said member means includes manually displaceable actuator means for displacing said pusher means in said one direction, and biasing means biasing said member means in said other of said opposite directions.

12. A needle threading device according to claim 11, wherein said housing means has opposite ends, said needle positioning means and thread positioning means being at one of said opposite ends, and said actuator means being at the other of said opposite ends.

13. A needle threading device according to claim 12, wherein said gripping fingers are integral with said housing means.

14. A needle threading device according to claim 13, wherein said actuator means includes a push buttom supported by said housing means at said other of said opposite ends for reciprocation toward and away from said one end of said housing means, said biasing means biasing said push button in the direction away from said one end.

15. A needle threading device according to claim 8, wherein said gripping fingers are integral with said housing means.

16. A needle threading device according to claim 1, wherein said housing means has opposite ends, said needle positioning means and thread positioning means being at one of said opposite ends, and said means to displace said member means includes manually displaceable actuator means outwardly adjacent said housing means and between said opposite ends.

17. A needle threading device according to claim 16, wherein said housing means has a length in the direction between said opposite ends and a height and width transverse thereto, said length being several times greater than each said height and width.

18. A needle threading device according to claim 17, wherein said housing means includes top and bottom walls spaced apart to provide said height, said actuator means being outwardly adjacent said top wall.

19. A needle threading device according to claim 18, wherein said needle threading member means is reciprocable in the direction between said opposite ends, and said actuator means is reciprocable relative to said top wall in the direction between said opposite ends.

20. A needle threading device according to claim 18, wherein said housing means includes a pair of side walls spaced apart to provide said width, said side walls diverging in the direction from said one end of said housing means toward the other.

21. A needle threading device according to claim 20, wherein said needle threading member means is reciprocable in the direction between said opposite ends, and said actuator means is reciprocable relative to said top wall in the direction between said opposite ends.

22. A needle threading device according to claim 21, wherein a portion of said bottom wall of said housing means is undulated in the direction between said opposite ends.

23. A needle threading device according to claim 19, wherein a portion of said bottom wall of said housing means is undulated in the direction between said opposite ends.

24. In a needle threading device comprising housing means having opposite ends, needle threading member means supported in said housing means for displacement along a path between retracted and extended positions relative to one of said opposite ends, means to displace said threading member means between said retracted and extended positions, and means at said one end of said housing means to position a thread and the eye of a needle to be threaded in alignment with said path, the improvement comprising: said housing means having opposed top and bottom walls and opposed side walls, said top and bottom walls providing a height for said housing means, and said side walls providing a width for said housing means, said housing means having a length between said opposite ends several times greater than each said width and height, said means to displace said threading member means including manually displaceable actuator means outwardly adjacent one of said housing walls, said actuator means being linearly displaceable along said one wall in the direction between said opposite ends, and said one wall and the wall of said housing means opposite said one wall being spaced apart to facilitate grasping thereof between the forefinger and thumb of a user for manipulation of said actuator means by the corresponding one of said forefinger and thumb, said one housing wall being said top wall of said housing means.

25. A needle threading device according to claim 24, wherein a portion of said bottom wall of said housing means is undulated in the direction between said opposite ends.

26. A needle threading device according to claim 24, wherein said side walls diverge in the direction from said one end of said housing means toward the other.

27. A needle threading device according to claim 26, wherein a portion of said bottom wall of said housing means is undulated in the direction between said opposite ends.

28. A needle threading device according to claim 26, wherein the end of said housing means opposite said one end projects downwardly relative to the plane of the bottom wall of said housing means at said one end.

* * * * *